US006378283B1

(12) United States Patent
Barton

(10) Patent No.: US 6,378,283 B1
(45) Date of Patent: Apr. 30, 2002

(54) MULTIPLE CONDUCTOR ELECTRICAL CABLE WITH MINIMIZED CROSSTALK

(75) Inventor: John A. Barton, Bellingham, MA (US)

(73) Assignee: Helix/HiTemp Cables, Inc., Franklin, MA (US)

( * ) Notice: Subject to any disclaimer, the term of this patent is extended or adjusted under 35 U.S.C. 154(b) by 0 days.

(21) Appl. No.: 09/578,289

(22) Filed: May 25, 2000

(51) Int. Cl.[7] ..... D01H 1/10

(52) U.S. Cl. ..... 57/58.52; 57/58.49; 57/58.63; 57/58.65; 57/58.7; 57/58.72; 57/58.81; 59/60; 59/61; 59/62; 59/63; 59/64; 66/314

(58) Field of Search ..... 57/58.49, 58.52, 57/58.63, 58.65, 58.7, 58.72, 58.81, 59, 60, 61, 62, 63, 64, 66, 314

(56) References Cited

U.S. PATENT DOCUMENTS

| | | | | |
|---|---|---|---|---|
| 483,285 | A | 9/1892 | Guilleaume | |
| 1,132,452 | A | 3/1915 | Davis | |
| 1,700,606 | A | 1/1929 | Beaver | |
| 1,977,209 | A | 10/1934 | Sargent | 173/264 |
| 1,995,201 | A | 3/1935 | Delon | 173/265 |
| 2,501,457 | A | 3/1950 | Thelin | 200/143 |
| 2,882,676 | A | 4/1959 | Bryan et al. | 57/138 |
| 3,340,112 | A | 9/1967 | Davis et al. | 156/47 |
| 3,559,390 | A | 2/1971 | Staschewski | 57/6 |
| 3,603,715 | A | 9/1971 | Eilhardt et al. | 174/15 |
| 3,644,659 | A | 2/1972 | Campbell | 174/27 |
| 3,696,599 | A | * 10/1972 | Palmer et al. | 57/1 |
| 3,819,443 | A | 6/1974 | Simons et al. | 156/204 |
| 3,949,543 | A | 4/1976 | Bittman | 57/34 R |
| 4,384,447 | A | 5/1983 | Faulstich | 57/58.52 |
| 4,389,838 | A | 6/1983 | Adelhard et al. | 57/71 |
| 4,408,443 | A | 10/1983 | Brown et al. | 57/204 |
| 4,426,837 | A | 1/1984 | Meilenner et al. | 57/293 |

(List continued on next page.)

FOREIGN PATENT DOCUMENTS

| | | | |
|---|---|---|---|
| DE | 4336230 C1 | 3/1995 | H01B/11/08 |
| EP | 0211750 B1 | 2/1987 | H04B/3/00 |
| EP | 0211750 A2 | 2/1987 | H04B/3/00 |
| EP | 0763831 | 3/1997 | H01B/11/06 |

(List continued on next page.)

OTHER PUBLICATIONS

"Engineering Design Guide" C&M Corporation, pp. 10–11, 1992.

images of Belden 1711A Datatwist 300 4PR23 shielded cable, Sep. 11, 1995.

Norblad, Sigurd, "Cross–stranding of telephone cables", *Telecommunication Journal*, vol. 41, No. 4, 1974, pp. 261–266.

*Primary Examiner*—John J. Calvert
*Assistant Examiner*—Shaun R Hurley
(74) *Attorney, Agent, or Firm*—Testa, Hurwitz & Thibeault, LLP

(57) ABSTRACT

A process and apparatus for manufacturing multiple conductor cable having improved transmission parameters. The apparatus includes a rotatable alignment die having a plurality of apertures. At least one strand of the multiple conductor cable is caused to traverse an aperture of the rotatable alignment die. A rotation motor causes the strand to rotate about its elongate axis, and a translation motor causes the strand, or the cable, to traverse along its elongate axis. The multiple conductors are brought into a predetermined mutual mechanical alignment that is calculated to produce a cable having at least one improved transmission parameter. The cable can additionally include a support member adapted to maintain the conductors in the mutual mechanical alignment. A binder is applied to the cable to maintain the conductors in the predetermined mutual alignment. Tests performed on cable manufactured using the principles of the invention demonstrate improved transmission characteristics as compared to cable made without using the principles of the invention.

11 Claims, 9 Drawing Sheets

U.S. PATENT DOCUMENTS

| | | | | |
|---|---|---|---|---|
| 4,429,520 | A | 2/1984 | Garner et al. | 57/293 |
| 4,450,674 | A | 5/1984 | Bos et al. | 57/6 |
| 4,530,205 | A | 7/1985 | Seiler et al. | 57/9 |
| 4,600,268 | A | 7/1986 | Spicer | 350/96.23 |
| 4,677,816 | A * | 7/1987 | Woxholt | 57/59 |
| 4,697,051 | A | 9/1987 | Beggs et al. | 178/63 D |
| 4,778,246 | A | 10/1988 | Carroll | 350/96.23 |
| 4,807,962 | A | 2/1989 | Arroyo et al. | 350/96.23 |
| 4,865,086 | A | 9/1989 | Robinson et al. | 140/118 |
| 4,873,393 | A | 10/1989 | Friesen et al. | 174/34 |
| 5,010,210 | A | 4/1991 | Sidi et al. | 174/34 |
| 5,149,915 | A | 9/1992 | Brunker et al. | 174/36 |
| 5,162,609 | A | 11/1992 | Adriaenssens et al. | 174/34 |
| 5,177,809 | A | 1/1993 | Zeidler | 385/105 |
| 5,289,556 | A | 2/1994 | Rawlyk et al. | 385/112 |
| 5,418,878 | A | 5/1995 | Sass et al. | 385/101 |
| 5,424,491 | A | 6/1995 | Walling et al. | 174/113 R |
| 5,438,571 | A | 8/1995 | Albrecht et al. | 370/94.3 |
| 5,544,270 | A | 8/1996 | Clark et al. | 385/101 |
| 5,563,377 | A | 10/1996 | Arpin et al. | 174/121 A |
| 5,574,250 | A | 11/1996 | Hardie et al. | 174/36 |
| 5,647,195 | A | 7/1997 | Josoff | 57/67 |
| 5,689,090 | A | 11/1997 | Bleich et al. | 174/121 A |
| 5,782,075 | A | 7/1998 | Meggle | 59/264 |
| 5,789,711 | A | 8/1998 | Gaeris et al. | 174/113 C |
| 5,841,072 | A | 11/1998 | Gagnon | 174/110 F |
| 5,841,073 | A | 11/1998 | Randa et al. | 174/113 R |
| 5,887,032 | A | 3/1999 | Cioffi | 375/257 |
| 5,921,818 | A | 7/1999 | Larsen et al. | 439/676 |
| 5,926,509 | A | 7/1999 | Stewart et al. | 375/257 |
| 5,931,474 | A | 8/1999 | Chang et al. | 277/316 |
| 5,952,607 | A | 9/1999 | Friesen et al. | 174/34 |
| 5,952,615 | A | 9/1999 | Prudhon | 174/113 C |
| 5,969,295 | A | 10/1999 | Boucino et al. | 174/113 C |
| 6,017,237 | A | 1/2000 | Sullivan | 439/392 |
| 6,074,503 | A | 6/2000 | Clark et al. | 156/50 |
| 6,150,612 | A | 11/2000 | Grandy et al. | 174/113 C |
| 6,153,826 | A | 11/2000 | Kenny et al. | 174/27 |

FOREIGN PATENT DOCUMENTS

| | | | |
|---|---|---|---|
| EP | 0883139 A1 | 12/1998 | H01B/11/04 |
| JP | 09139121 | 5/1997 | H01B/11/04 |
| WO | WO96/41908 | 12/1996 | D01H/1/10 |
| WO | WO98/48430 | 10/1998 | H01B/11/08 |
| WO | WO99/54889 | 10/1999 | H01B/11/02 |
| WO | WO01/08167 A1 | 2/2001 | H01B/7/18 |

* cited by examiner

SECTION A-A

SECTION B-B

| PRE-ROTATING DIE | POST-ROTATING DIE |
|---|---|
| 3 | 10.8 |
| 2.1 | 10.6 |
| -1.1 | 8.2 |
| 1.2 | 7.1 |
| 5.3 | 9.6 |
| 5.2 | 8.5 |
| 5.2 | 9.6 |
| 3.9 | 9.5 |
| 4.3 | 7 |
| 2.9 | 10.2 |
| 3.5 | 8.4 |
| 5.2 | 7.1 |
| 3.5 | 7.5 |
| 2.5 | 6.4 |
| 0.7 | 8.2 |
| 0.5 | 7.6 |
| -1.4 | 5.5 |
| -0.4 | 9.6 |
| 2.146351 | 1.465488 STD DEV |
| 2.561111 | 8.411111 AVG |
| | AVERAGE IMPROVEMENT 5.85 dB |

MULTIPLE CONDUCTOR ELECTRICAL CABLE WITH MINIMIZED CROSSTALK

FIELD OF THE INVENTION

This invention relates generally to systems and methods for manufacturing multiple conductor electrical cable. More particularly, the invention relates to systems and methods for manufacturing multiple conductor electrical cable that exhibits an improved crosstalk margin relative to industry standards, as well as cable produced by such systems and methods.

BACKGROUND OF THE INVENTION

Multiple conductor electrical cable for use in applications such as telecommunication and communication between computers are well known. Nevertheless, the increases in transmission rates, measured in bits of information per second, required to transmit large amounts of information at high speed severely tax the capabilities of conventional multiple conductor electrical cables. For example, computer communications using data rates of more than one gigabit per second are now contemplated using inexpensive twisted pair electrical cable, rather than more expensive transmission media such as coaxial cable. Transmission rates of the order of a gigabit per second have been considered excessive for systems that rely on twisted pair copper conductor cable, based on high levels of electromagnetic interference that were expected to be encountered. Recent advances in electronics have created a need for cable that can accommodate high transmission rates, such as a gigabit per second, with acceptably low noise, low crosstalk, and low cost.

While multiple conductor electrical cable, including twisted pair cable, has been in use for many years, there are significant problems in making twisted pair cable that can perform within the requirements of technical standards such as TIA/EIA-568-A Commercial Building Telecommunications Cabling Standard, known as Category 5e, the disclosure of which is incorporated herein by reference in its entirety. Extended lengths (for example, greater than 100 meters, or approximately 328 feet) of twisted pair cable made by the methods of the prior art often fail to satisfy the Category 5e standard. However, for a cable manufacturing method to be useful, one must routinely satisfy the standard of performance for cable that exceeds a length of 100 meters or even a length of 1000 meters.

SUMMARY OF THE INVENTION

The present invention provides systems and methods for manufacturing multiple conductor electrical cable with improved transmission parameters, for example, reduced crosstalk, than is possible using the systems and methods of the prior art. The multiple conductor electrical cable produced using the systems and methods of the invention exhibits both improvements in the transmission parameters and reductions in the variations in the transmission parameters that control the quality of the transmission as compared to cable manufactured without the systems and methods of the invention. For example, cable made according to the teachings of the invention exhibit increased margins by which the transmission parameters exceed the requirements specified in Category 5e, as compared to cable made without the systems and methods of the invention.

Some of the advantages that the systems and methods of the invention provide include higher quality multiple conductor electrical cable, greater assurance that manufactured cable will meet or exceed the specifications required to conform to an industrial standard (e.g., that the cable will be acceptable for use, or "merchantable"), higher rates of production, and lower incremental costs to implement the systems and methods of the invention.

In one aspect, the invention features a multiple conductor cable that includes a plurality of elongate conductors disposed in a predefined mutual mechanical alignment. This mutual mechanical alignment is calculated to provide a cable that includes at least one transmission parameter optimized with respect to Category 5e. The mutual mechanical alignment of the cable is defined by a rate of advance of at least one of the conductors through a rotatable alignment die and a rate of rotation of at least one of the conductors substantially about its elongate axis. In some embodiments, a binder may be applied to the plurality of conductors.

In one embodiment, the invention may include the multiple conductor cable in which at least one transmission parameter selected from the group of transmission parameters consisting of input impedance, characteristic impedance, resistance unbalance, mutual capacitance, capacitance unbalance to ground, capacitance unbalance to shield, attenuation, Near End Cross Talk ("NEXT"), Power Sum NEXT, Equal Level Far End Cross Talk ("ELFEXT"), and Power Sum ELFEXT is optimized with respect to Category 5e.

In another embodiment, the invention includes the multiple conductor cable in which the mutual mechanical alignment is calculated to provide a cable including a NEXT that exceeds the NEXT specified in Category 5e as expressed in Table I below by no less than 2 decibels, more preferably no less than 5 decibels, and most preferably no less than 10 decibels.

Table I

| Frequency (MHz) | NEXT (dB) |
|---|---|
| 0.150 | 77.7 |
| 0.772 | 67.0 |
| 1.0 | 65.3 |
| 4.0 | 56.3 |
| 8.0 | 51.8 |
| 10.0 | 50.3 |
| 16.0 | 47.3 |
| 20.0 | 45.8 |
| 25.0 | 44.3 |
| 31.25 | 42.9 |
| 62.5 | 38.4 |
| 100.0 | 35.8 |

In some embodiments, the invention comprises a multiple conductor cable including a binder in which the binder may be a tubular sheath, a helical wrapping, a longitudinally slotted sheath, or an array of individual ties. In some embodiments, the invention comprises the multiple conductor cable in which the binder is made from a material that is heat shrinkable, is flame retardant, and/or is a thermosetter.

In some embodiments, the invention includes a multiple conductor cable that has a single twisted pair of conductors, or that has multiple twisted pairs of conductors.

In some embodiments, the invention includes a multiple conductor cable that has a mechanical alignment component that is incorporated into the cable to stabilize the mutual mechanical alignment of the conductors. In one embodiment, the mechanical alignment component may have a finned configuration and the fin(s) may be positioned substantially parallel to the length of the mechanical alignment component. The fin(s) may be conductive, or, alternatively, the fin may be non-conductive.

In another aspect, the invention features an apparatus for manufacturing a multiple conductor cable from a plurality of elongate conductors. The apparatus includes a rotatable aligning die that includes a plurality of apertures. The apparatus includes an applicator that can apply a binder to the plurality of conductors. The apparatus may have one or more motors that cause the plurality of elongate conductors to traverse along its elongate axis, and that also cause the plurality of elongate conductors to rotate substantially about its elongate axis. The apparatus causes the plurality of elongate conductors to traverse at least one of the apertures of the aligning die. The apparatus causes the elongate conductors to be brought into a defined mutual mechanical alignment. The elongate conductors may be retained in a mutual mechanical alignment, at least partially, by the application of the binder.

In some embodiments, the invention includes an apparatus that has a support situated substantially along a rotation axis of the die. The support stabilizes the mutual mechanical alignment of the plurality of elongate conductors. In some embodiments, the support traverses the rotational die and is incorporated into the cable that is manufactured.

In one embodiment, the invention includes a support fixture that can adjustably position the binder applicator relative to the position where the elongate conductors are brought into mutual mechanical alignment.

In some embodiments, the apparatus includes a binder applicator adapted to dispense a binder material that can bind the plurality of conductors together.

In one embodiment, the invention includes a rotatable aligning die that includes a rotatable body that includes a circular periphery and a plurality of apertures through the rotatable body. Each of the plurality of apertures is adapted to receive one or more elongate conductors. The apertures are aligned in the rotatable body substantially transversely to a plane defined by the circular periphery of the rotatable body. The rotatable aligning die also includes a fixing collar that can be adjustably attached to the apparatus for manufacturing a multiple conductor cable. The rotatable body is capable of rotating relative to the fixing collar. The rotatable aligning die may include at least one ball bearing situated at the circular periphery of the rotatable body and supporting the rotatable body within the fixing collar.

In another aspect, the invention features a rotatable aligning die for the manufacture of multiple conductor electrical cable, including a rotatable body that includes a circular periphery and a plurality of apertures through the rotatable body. The apertures are aligned in the body substantially transversely to a plane defined by the circular periphery of the body. Each of the plurality of apertures can receive one or more elongate electrical conductors. The rotatable aligning die includes a fixing collar that can be adjustably attached to an apparatus for manufacturing a multiple conductor cable. The rotatable aligning die includes at least one ball bearing situated at the circular periphery of the rotatable body. The ball bearing(s) support the rotatable body within the fixing collar. The rotatable body can rotate relative to the fixing collar. The application of rotational force to at least one of the electrical conductors causes the rotation of the rotatable body.

In another aspect, the invention features a process for manufacturing a multiple conductor cable from a plurality of elongate conductors. The process includes the step of providing a rotatable aligning die that includes a plurality of apertures, and providing an applicator that can apply a binder to at least two of the plurality of conductors. The process includes the steps of advancing at least one of the plurality of elongate conductors through at least one of the apertures of the aligning die, and rotating at least one of the plurality of elongate conductors about its elongated axis. The process includes the step of bringing the plurality of elongate conductors into a defined mutual mechanical alignment. The process includes the step of retaining at least two of the plurality of elongate conductors in the mutual mechanical alignment at least partially by the application of the binder.

In one embodiment, the invention includes the step of providing a consumable mechanical alignment component that is incorporated into the cable to stabilize the mutual mechanical alignment of at least two of the plurality of conductors. In another embodiment, the invention includes providing a support member disposed substantially along a rotation axis of the aligning die to stabilize the mutual mechanical alignment of at least two of the plurality of conductors.

In another aspect, the invention features a multiple conductor cable including a plurality of elongate conductors produced by the process described above.

The foregoing and other objects, aspects, features, and advantages of the invention will become more apparent from the following drawings, description, and claims.

BRIEF DESCRIPTION OF THE DRAWINGS

The objects and features of the invention can be better understood with reference to the drawings described below. The drawings are not necessarily to scale, emphasis instead generally being placed upon illustrating the principles of the invention.

DETAILED DESCRIPTION

One of the least understood characteristics of paired cables is crosstalk because crosstalk depends on many variables. A great deal of attention is paid to the individual pairs in a cable, with respect to lay length and variation of lay length, but little attention is paid to the overall geometry of the cable lay-up. This is due in part to the relatively long cable lay and the method in which the twisted pairs are layed up. It becomes very difficult to maintain a specific geometry that allows for equal center-to-center spacing of the individual pairs. This center-to-center spacing is one of the characteristics that are critical to achieving enhanced crosstalk performance. In addition to difficulty in establishing optimal spacing, degradation of the geometry can occur when the cable is payed off over a number of sheaves prior to being insulated, resulting in increased crosstalk.

In overview, the present invention includes in one embodiment a device that brings the geometry of the pairs closet to the desired center-to-center spacing to provide improved crosstalk performance. The device in one embodiment is comprised of a rotatable die with four holes therethrough. The die is set into a bearing. The bearing assembly is then set into a holder designed to fit a core-tube of a jacketing crosshead, or otherwise to allow the cable that is manufactured to be provided with a sheath. The four pairs that are included in the cable are then sequentially threaded through the holes in the dies and then through the crosshead and are tied to a lead cable. A hole is strategically placed in the bearing holder to allow for the insertion of a rip cord. This assembly is placed in the back of the crosshead core tube and the insulating process begins. As the cable is being pulled through the rotating die, the lay of the cable is opened up and subsequently closes soon after exiting the die. The procedure allows for the necessary adjustments to the geometry of the pairs. The crosstalk parameter of the cable manufactured according to the principles of the invention is optimized.

Figure 1:
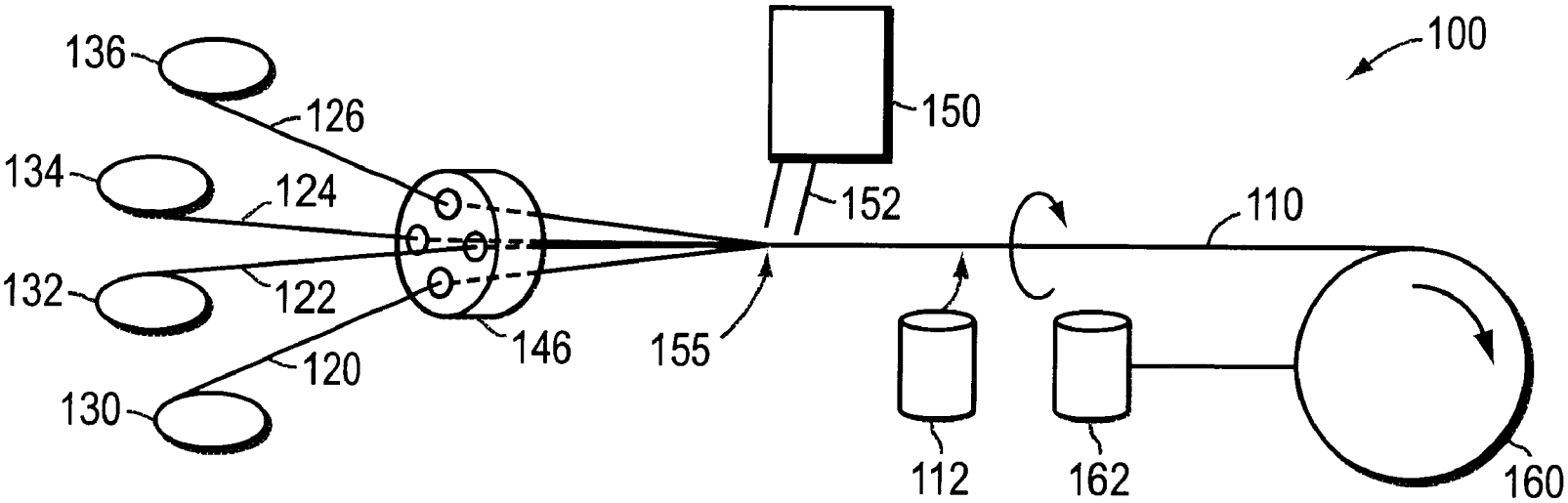
FIG. 1 is a schematic overview of an embodiment of the system of the invention that shows the relationships of the components used in manufacturing a multiple conductor electrical cable according to the principles of the invention.

Referring to FIG. 1, a schematic overview of an embodiment of the system 100 of the invention is presented that shows the relationships of the components used in manufacturing a multiple conductor electrical cable 110. In the exemplary embodiment shown, the multiple conductor electrical cable 110 is constructed from four strands 120, 122, 124, and 126 that are delivered from respective sources, such as reels 130, 132, 134, 136. The strands 120, 122, 124, and 126 can be electrical conductors of different types, such as individual wires, some of which may be insulated and some of which may not be insulated, or they can be multiple conductors including insulated wires. The strands 120, 122, 124, and 126 can be a plurality of the same type of conductor. In one embodiment, the strands 120, 122, 124, and 126 are twisted pairs of insulated wire. As is known in the art, the number of twists per unit length of strand may be different for different strands 120, 122, 124, and 126. The exemplary embodiment depicts an example in which four strands 120, 122, 124, and 126 are employed to make a multiple conductor electrical cable 110.

The multiple conductor electrical cable 110 of the exemplary embodiment can be used for connections between computers or other electronic devices that communicate at high speed. In other embodiments, the communication requirements may suggest the use of a cable having fewer than four twisted pairs, for example, the connection of a telephone to a switching system. Alternatively, the requirements may suggest the use of a cable having more than four twisted pairs, for example, in providing wiring to be installed at the time of construction of a building, such that the wiring allows for a variety of potential uses and communication configurations. It is possible to employ the systems and methods of the invention using a broad range of strands. In one embodiment, each strand can be a twisted pair, and any convenient number of strands may be employed to make a multiple conductor electrical cable 110. As an example, it is possible to produce a multiple conductor electrical cable using the principles of the invention in which a first cable having, for example, six strands of twisted pair conductors is produced. In this example, the first cable can then be used as a central core in a further iteration of the process, wherein a second layer of strands is applied to the six strand core cable, for example, a layer having an additional 12 strands. By repeating the process in a suitable stepwise manner, a cable having a desired number of strands can be produced. In some embodiments, the strands can be single conductors or multiple conductors. The number of conductors that any individual strand may include can be the same as or different from the number of conductors that another strand may include. Cables having tens or hundreds of strands can be produced using the principles of the invention.

In the exemplary embodiment depicted in FIG. 1, the strands 120, 122, 124, and 126 pass through apertures defined in a rotatable body 146 of rotatable alignment die 140, with each strand 120, 122, 124, and 126 passing through its own aperture 148. The apertures 148 defined in the surface of the rotatable body 146 of rotatable alignment die 140 are oriented so as to permit each strand 120, 122, 124, and 126 to pass through the rotatable body 146 of rotatable alignment die 140 in a direction oriented within 45 degrees of the rotation axis 149 of the rotatable body 146 of rotatable alignment die 140. The rotatable body 146 of rotatable alignment die 140 is held rotatably in a fixing collar 142. The fixing collar 142 can be attached, for example, by an adjustable bracket that allows the fixing collar 142 to be adjustably positioned relative to the supply of strands 130, 132, 134, and 136 and relative to a binder applicator 150. The strands 120, 122, 124, and 126 are aligned to come together at a controlled location 155 beyond the rotatable body 146 of rotatable alignment die 140. The multiple conductor electrical cable 110 can be caused to rotate about its elongated axis by the action of a rotation motor 112, which can be an electric motor or the like connected to the multiple conductor electrical cable 110 by a drive system. Torque or angular velocity can be imparted by the rotation motor 112 to at least one of the strands 120, 122, 124, and 126 that make up the multiple conductor electrical cable 110 along the elongated axis of the strand 120, 122, 124, and 126. The multiple conductor electrical cable 110 is also caused to traverse along its elongated axis, or equivalently, translate along its length from the controlled location 155 to a take-up reel 160, at a controlled velocity by the action of a translation motor 162. For example, the translation motor 162 can be connected to rotate a take-up reel 160 that collects the multiple conductor electrical cable 110 as the multiple conductor electrical cable 110 is being produced. Other mechanisms to impart linear motion to a strand 120, 122, 124, and 126, or to a multiple conductor electrical cable 110, are known and may be employed to cause the multiple conductor electrical cable 110 to translate to a take-up location at a controlled velocity. In some embodiments, the rotation motor 112 and the translation motor 162 may be the same motor and the two motions may be produced by the connection of multiple power trains to the motor, which operates at a controlled speed. Power trains that use adjustable gearing or other speed control mechanisms can be used to generate the desired rotational velocity and translational velocity for the multiple conductor electrical cable 110.

In some embodiments, a binder may be applied to bind the strands 120, 122, 124, and 126 of the multiple conductor electrical cable 110 into an assembly in which each strand 120, 122, 124, and 126 is held in the mutual mechanical alignment imparted to it by passing through the apertures 148 of the rotatable body 146 of rotatable alignment die 140. In one embodiment, the binder can be a material that can be softened thermally. In another embodiment the binder can be a thermosetting material. In some embodiments, the binder can be a mechanical binder such as a helical sheath, a sheath having a longitudinal slit, a series of wrappings, such as tie-wraps, or the like. The binder can be made from materials that have desirable properties, such as materials that are electrical insulators, materials that are capable of serving as a Faraday cage, materials that are fire resistant, materials that are color coded to make identification of the product easy, materials that have a low coefficient of friction, and the like.

A binder applicator 150 is positioned to deliver the binder to the multiple conductor electrical cable 110 substantially at controlled location 155 where the strands 120, 122, 124, and 126 come together to form the multiple conductor electrical cable 110. The precise position of application of the binder relative to the rotatable alignment die 140 and the controlled location 155 can be adjusted by positioning the binder applicator 150 on an adjustable bracket or the like. The binder can be applied to the multiple conductor electrical cable 110 by flowing the binder through a tube 152 connected to the applicator 150. Alternatively, the binder can be applied by passing the multiple conductor electrical cable 110 through apertures in the binder applicator 150, so that the motion of the multiple conductor electrical cable 110 causes the binder to be applied to the cable 110. As is known in the control arts, one or more controllers, such as a computer, a programmable controller, or manually adjustable controls can be used to control the manufacturing process.

FIGS. 2A through 2F illustrate the design and construction of an embodiment of the rotatable alignment die 140 in different views.

Figure 2A:
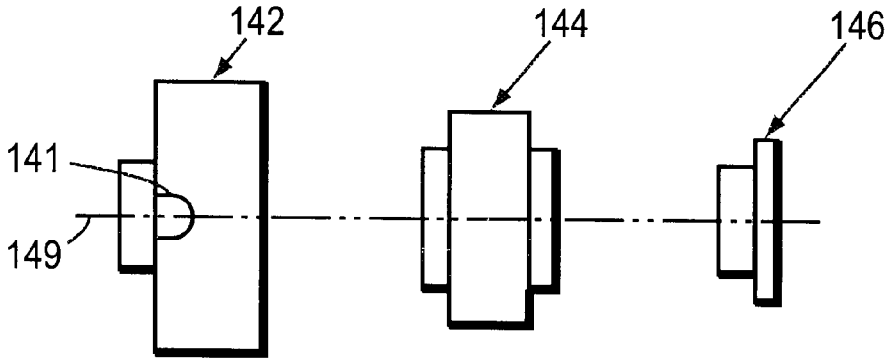
FIGS. 2A–2F are different views of an embodiment of the invention in the form of a rotating die.

FIG. 2A shows the rotatable alignment die 140 in exploded view, with a fixing collar 142 at the leftmost position, a ball or roller bearing 144 in the middle position, and a rotatable body 146 in the rightmost position. A rotation axis 149 is shown, which is the axis of rotation of the ball or roller bearing 144 and of the rotatable body 146. The application of torque, or rotational force, to at least one of the strands 120, 122, 124, and 126 passing through the rotatable body 146 of rotatable alignment die 140 will cause the rotatable body 146 to experience a torque because none of the strands 120, 122, 124, and 126 passes through the rotatable body 146 along its rotation axis 149, but rather at a point displaced from the rotation axis 149, as will become apparent upon consideration of FIG. 2D. A keyway 141 is provided in fixing collar 142 to permit fixing collar 142 to be held in a defined angular position within the apparatus by the action of a locating key. The ball or roller bearing 144 provides low resistance to rotation, and supports the rotatable body 146 at its outer circular periphery. The rotatable body 146 is capable of responding to the torque that is applied to it by the one or more strands 120, 122, 124, and 126 by rotating at a controlled angular velocity. This induced rotational motion of the rotatable body 146 causes the strands 120, 122, 124, and 126 to rotate about each other and to form a multiple conductor electrical cable 110 having a number of strands 120, 122, 124, and 126 that are twisted about one another. The application of a binder, described below in more detail, serves to hold the strands 120, 122, 124, and 126 in the relative positions and mutual orientations, or mutual mechanical alignment, that they possess at the time that the binder is applied. Alternative embodiments of the invention can include the use of other types of rotating bearings that provide low resistance to rotation, such as air bearings, fluid bearings, magnetic bearings and the like. In yet other alternative embodiments, the torque can be applied to the rotatable body 146 rather than to the strands 120, 122, 124, and 126 or to the multiple conductor electrical cable 110, for example by use of a motor coupled to the rotatable body 146, or by use of a combined fluid or pneumatic bearing and drive.

Figure 2B:
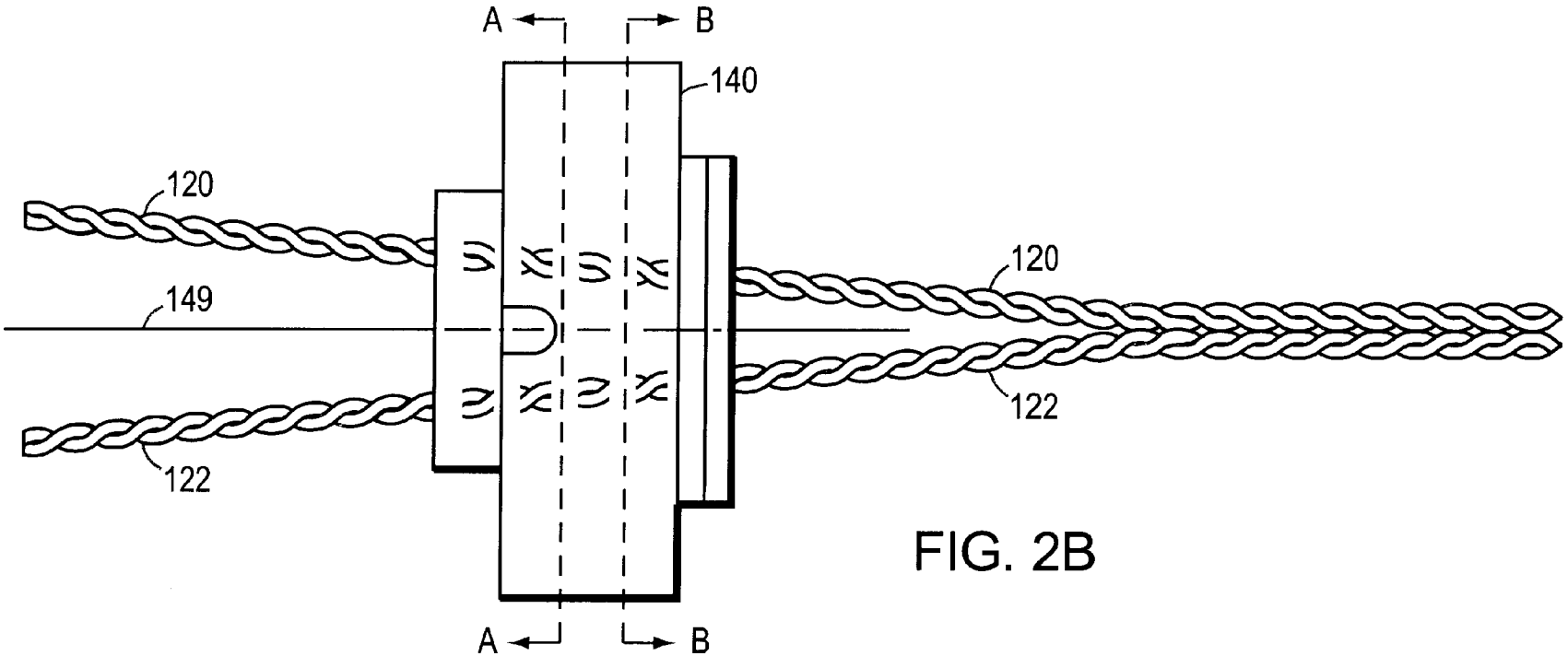

FIG. 2B is a side view of the rotatable alignment die 140 that shows multiple strands 120, 122 as they pass through the rotatable alignment die 140. The strands 120, 122 are depicted in FIG. 2B entering the rotatable alignment die 140 from the left of FIG. 2B, passing through the rotatable alignment die 140, and exiting the rotatable alignment die 140 on the right side of FIG. 2B. In this exemplary diagram, the strands 120, 122 form an angle of less than 45 degrees with a rotation axis 149 of the rotatable alignment die 140 as they pass through the rotatable alignment die 140. The Figure also shows the locations of the planes representing section A—A, shown in FIG. 2C, and section B—B, shown in FIG. 2D.

Figure 2C:
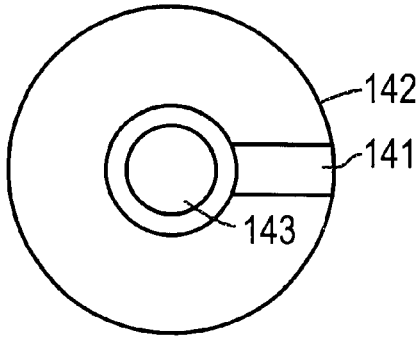

FIG. 2C is a section A—A through rotatable alignment die 140 that shows the fixing collar 142 that positions the rotatable alignment die 140 along the traverse direction of the multiple conductor electrical cable 110. The position of the section A—A is defined in FIG. 2B. The fixing collar 142 can be mechanically attached to the multiple conductor electrical cable manufacturing apparatus used for making the multiple conductor electrical cable 110, for example by means of an adjustable bracket that allows the fixing collar 142 to be adjustably positioned, as described more fully below. The keyway 141 is provided to allow the angular position of fixing collar 142 to be maintained by use of a locating key or pin. A central aperture 143 is defined within fixing collar 142, through which strands 120, 122, 124 and 126 can pass, and which permits a ball or roller bearing 144 and a rotatable body 146 to be supported by fixing collar 142.

Figure 2D:
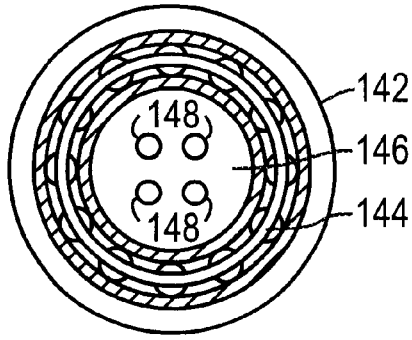

FIG. 2D is a section B—B through rotatable alignment die 140, the position of which is shown in FIG. 2B. FIG. 2D shows the fixing collar 142 that supports a ball or roller bearing 144 which in turn supports the rotatable body 146 of rotatable alignment die 140. The rotatable body 146 also defines the apertures 148 through which the strands 120, 122, 124, and 126 pass. The apertures 148 are aligned in the rotatable body 146 substantially transversely to a plane defined by the circular periphery of the rotatable body 146. In the exemplary embodiment shown, there are four apertures 148 defined in the rotatable body 146. In other embodiments, more or fewer apertures 148 may be defined in an embodiment of the rotatable body 146. In some embodiments the rotatable body 146 may also have an aperture 148 aligned substantially along the rotation axis 149 of the rotatable body 146. The aperture 148 aligned substantially along the axis 149 can be employed to adjustably support either a support member 170 described further with regard to FIG. 2E, or to permit a consumable mechanical alignment component 180, described further with regard to FIG. 2F, that is incorporated into the multiple conductor electrical cable 110 to pass through the rotatable body 146.

Figure 2E:
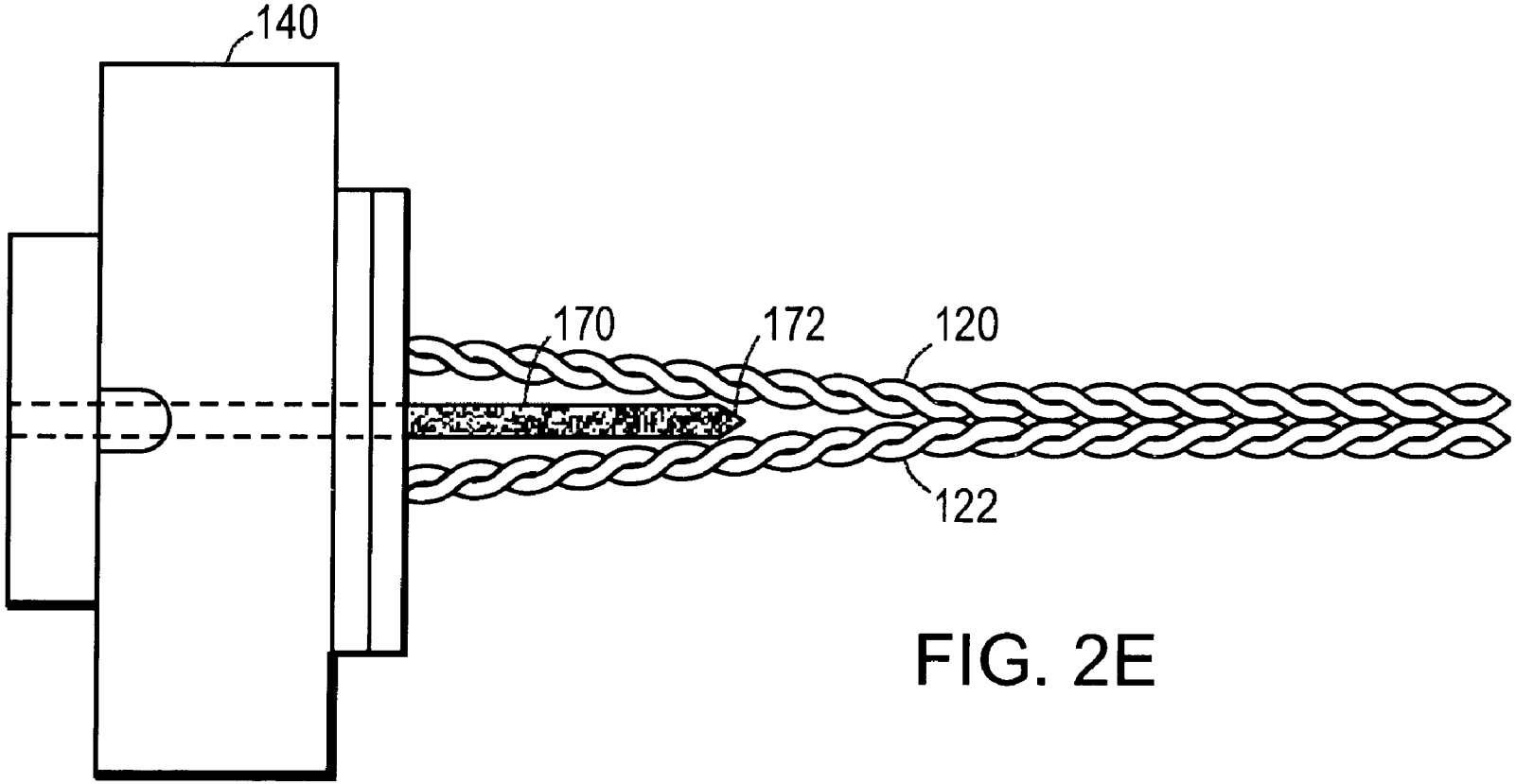

FIG. 2E depicts an embodiment of the rotatable alignment die 140 of the invention in which a support member 170 is provided. The support member 170 is preferably positioned to have an end 172 situated at the position where the strands 120, 122 come together to form the multiple conductor electrical cable 110. The support member 170 supports the strands 120, 122 mechanically as they come together. The support member 170 is adjustably held within the rotatable alignment die 140 so that the appropriate mechanical relationship between the support member 170 and the strands 120, 122 can be arranged. The support member 170 is fixed by use of a device such as a collar, a chuck, a set screw, or the like, in a manner similar to positioning a drill bit within the chuck of a drill. The application of the binder material fixes the mutual mechanical alignment of the strands 120, 122 so that the strands 120, 122 substantially retain the mutual mechanical alignment that exists at the point where the binder is applied. In one embodiment, the support member 170 does not become incorporated into the multiple conductor electrical cable 110.

Figure 2F:
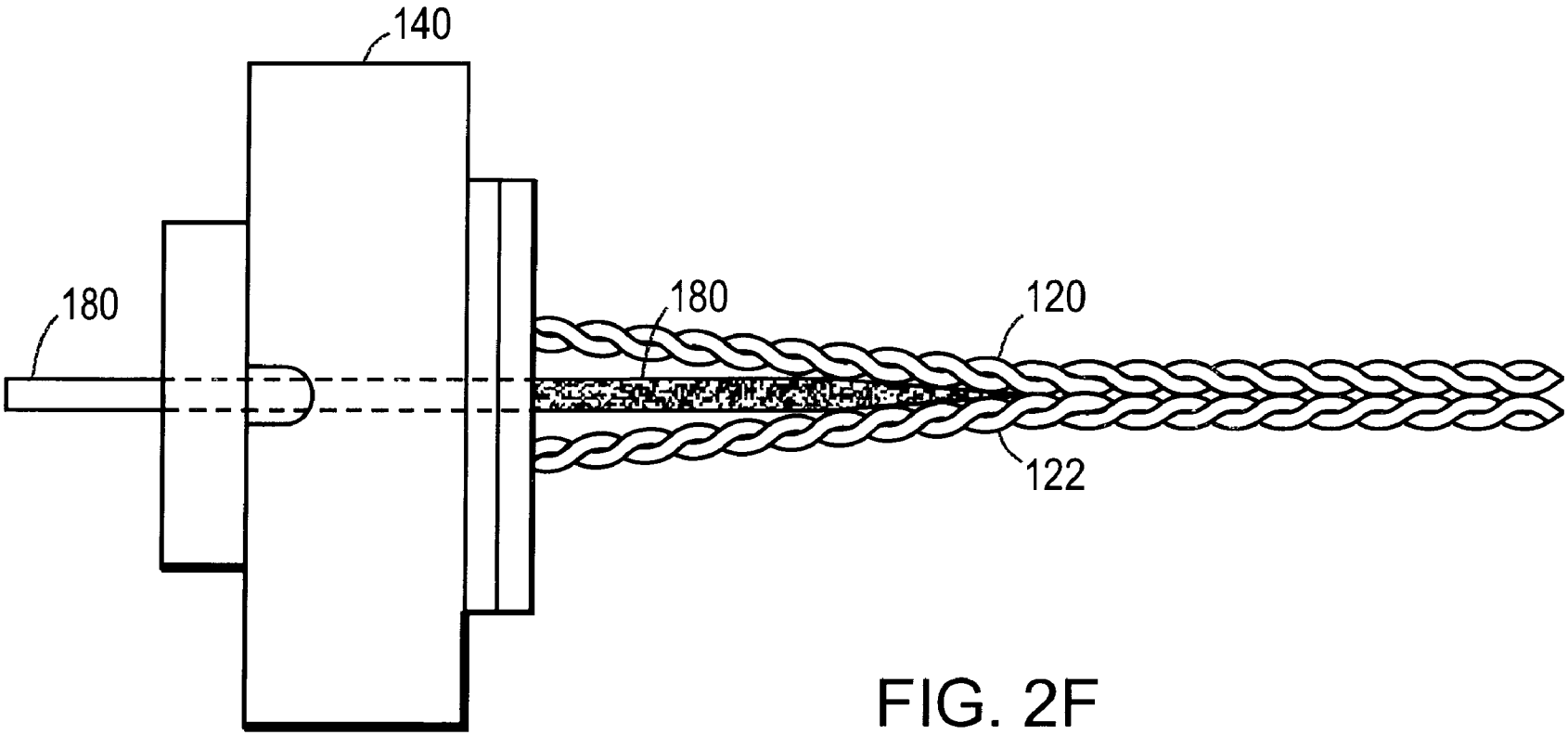

An alternative embodiment to FIG. 2E is shown in FIG. 2F. In FIG. 2F, a consumable mechanical alignment component 180 is supplied in a manner similar to the supply of strands 120, 122, 124, and 126. The consumable mechanical alignment component 180 passes through the aperture 148 aligned substantially along the axis 149 defined in rotatable alignment die 140. The consumable mechanical alignment component 180 is mechanically aligned with the strands 120, 122 and becomes incorporated into the multiple conductor electrical cable 110. The consumable mechanical alignment component 180 can be constructed with a particular geometry or shape to facilitate the mutual mechanical alignment of the strands 120, 122, and to assist in maintaining that mutual mechanical alignment once the multiple conductor electrical cable 110 is formed. The application of a binder material described above serves to maintain the mutual mechanical alignment of all of the components of the multiple conductor electrical cable 110.

The consumable mechanical alignment component 180 can be made from one or more materials that possess desirable properties, such as materials that are electrical insulators, materials that are capable of serving as a Faraday cage, materials that are fire resistant, materials that have flexibility or low density, and the like. The consumable mechanical alignment component 180 can be made with a particular shape or geometry that tends to improve one or more properties of the multiple conductor electrical cable 110. For example, the consumable mechanical alignment component 180 can have a cross section that resembles the letter "X," with one or more fins being oriented substantially parallel to the length of the consumable mechanical alignment component 180. The consumable mechanical alignment component 180 can additionally have one or more conductive surfaces, for example a conductive fin that tends to reduce the electrical or electromagnetic interference between conductors situated on opposite sides of the fin.

Figure 3:
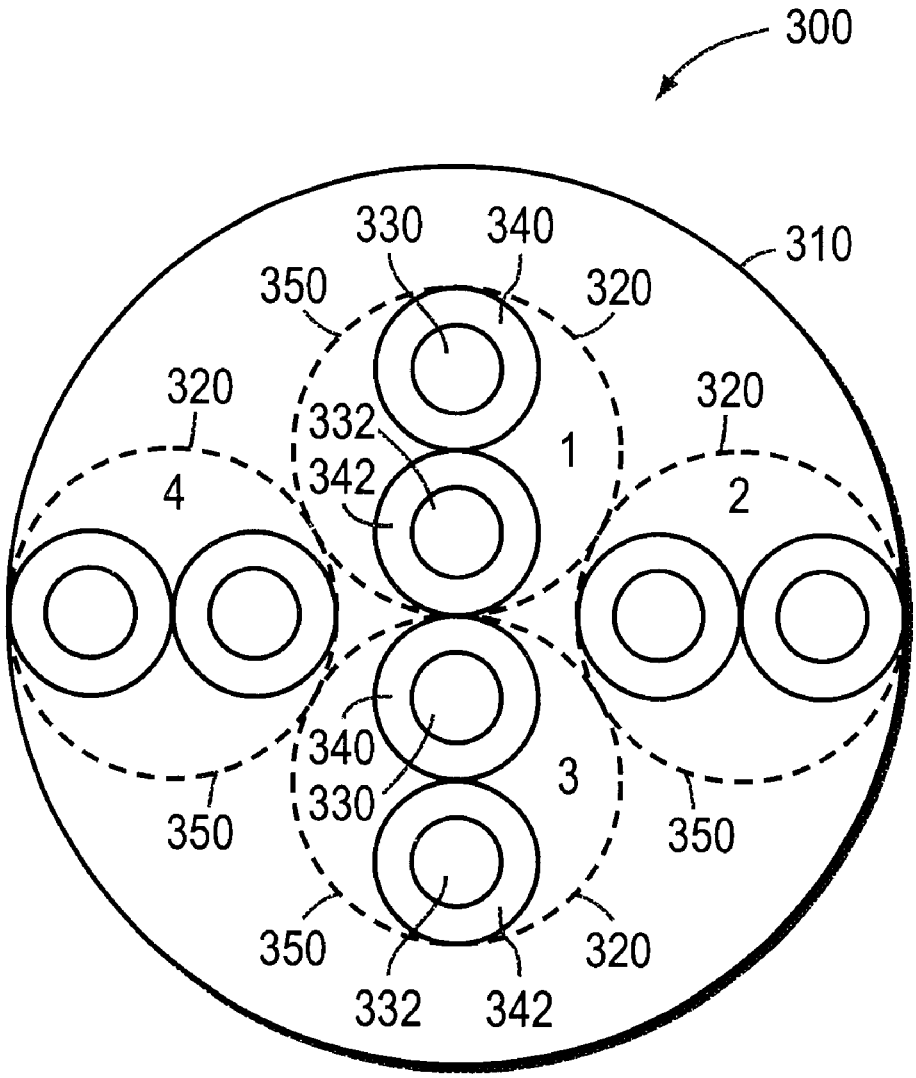
FIG. 3 shows a cross section of a multiple conductor electrical cable of the prior art.

FIG. 3 shows a cross section of a multiple conductor electrical cable 300 produced without using the principles of the invention. FIG. 3 illustrates a multiple conductor electrical cable 300 having an outer covering 310. Within the outer covering 310 is a plurality of twisted pair conductors 320. In the multiple conductor electrical cable that is depicted, there are four such twisted pairs 1, 2, 3, and 4. The four twisted pairs are substantially similar, each having a pair of single conductors 330, 332, and each conductor is surrounded by a respective layer of insulation 340, 342. Each twisted pair 1, 2, 3, and 4 is circumscribed with a dotted circle 350 which denotes the projection of the periphery of a cylinder of revolution defined by a rotation of the twisted conductor pair, if the twisted conductor pair were free to rotate about the direction perpendicular to the plane of FIG. 3. In other words, if one were to follow a twisted pair, such as twisted pair 1, along the length of multiple conductor electrical cable 300, one would observe that the twisted pair 1 would appear to "rotate" within the approximate confines of a cylinder depicted at any point along the multiple conductor electrical cable 300 by dotted circle 350. It is important to note that the distance between conductor 332 of twisted pair 1 and conductor 330 of twisted pair 3 is the sum of the thicknesses of the insulators 340 and 342 that cover conductor 330 and 332 in the section shown in FIG. 3. In the geometry of the multiple conductor electrical cable 300 of FIG. 3, the twisted pairs 1, 2, 3, and 4 are positioned closely with regard to each other. Twisted pairs 1 and 3 are depicted as having their respective insulation substantially in contact.

Figure 4:
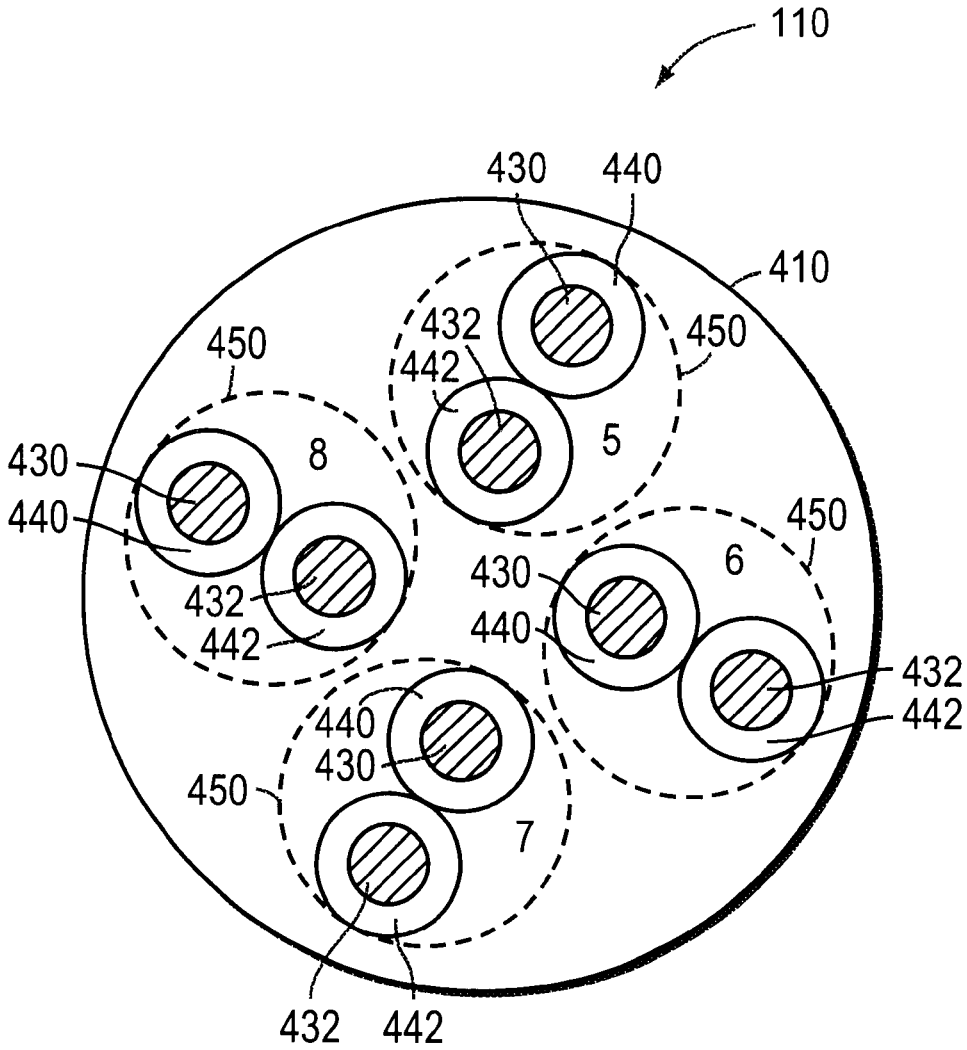
FIG. 4 shows a cross section of a multiple conductor electrical cable manufactured according to the principles of the invention.

FIG. 4 depicts a cross section of a multiple conductor electrical cable 110 manufactured according to the principles of the invention using a rotatable die. In this illustrative embodiment, the multiple conductor electrical cable 110 has an exterior covering 410. This exterior covering 410 can be the binder that is applied to the multiple conductor electrical cable 110 as described above. In the illustrative embodiment, the multiple conductor electrical cable 110 includes four twisted conductor pairs, labeled 5, 6, 7, and 8. Each twisted conductor pair includes two wires 430, 432. Each wire 430, 432 of each twisted conductor pair 5, 6, 7, 8 is enclosed in an insulator 440, 442. Each twisted conductor pair 5, 6, 7, and 8 is circumscribed by a dotted circle 450 that represents the projection of the periphery of a cylinder of revolution defined by a rotation of the twisted conductor pair, if the twisted conductor pair were free to rotate about a direction perpendicular to the plane of FIG. 4. In FIG. 4, the relative positions of one twisted conductor pair is generally farther away from the other twisted conductor pairs than in the design depicted in FIG. 3. Comparison of the mutual mechanical alignment of the twisted conductor pairs in FIG. 4 with the relative alignment of the twisted conductor pairs in FIG. 3 discloses that the alignment in FIG. 4 is substantially different from that depicted in FIG. 3. As shown, the mutual mechanical alignment of the twisted conductor pairs in the embodiment depicted in FIG. 4 is substantially a square array of twisted conductor pairs. A region in the middle of the mutual mechanical alignment is filled with material other than twisted conductor pairs, such as the consumable mechanical alignment component 180. By comparison, the structure of FIG. 3 shows twisted conductor pairs that are disposed in a substantially rhombohedral array, and that there is virtually no region in the "middle" of the array of FIG. 3 that does not comprise twisted conductor pairs.

It has been found that the structure illustratively embodied in FIG. 4 can be manufactured using the systems and methods of the present invention. In some embodiments, a consumable mechanical alignment component 180 can be employed to assure that the region in the center of multiple conductor electrical cable 110 that does not include twisted conductor pairs is occupied by the consumable mechanical alignment component 180, thus holding the twisted conductor pairs 5, 6, 7, 8 out of the center of the multiple conductor electrical cable 110. In other embodiments, the region in the center of multiple conductor electrical cable 110 that does not include twisted conductor pairs remains clear of twisted conductor pairs 5, 6, 7, 8 either because the region is filled partially or completely with binder material, or because the binder material restrains the twisted conductor pairs 5, 6, 7, 8 from reorienting themselves and moving to occupy the central region.

As is well known in the electrical arts, electromagnetic interference, or EMI, decreases with increasing distance between interacting conductors, all other factors being held constant. Observation of the relative alignments of the twisted conductor pairs 1, 2, 3, 4 in FIG. 3 and twisted conductor pairs 5, 6, 7, 8 in FIG. 4 reveals that (1) the electromagnetic interactions between the twisted conductor pairs 1, 2, 3, and 4 of FIG. 3 are expected to be greater than are the electromagnetic interactions between the twisted conductor pairs 5, 6, 7, and 8 of FIG. 4 because the twisted conductor pairs in FIG. 3 are generally closer to adjacent twisted conductor pairs than are those of FIG. 4, and (2) the electromagnetic interactions between the twisted conductor pairs 1, 2, 3, and 4 of FIG. 3 are subject to greater variations than are the electromagnetic interactions between the twisted conductor pairs 5, 6, 7, and 8 of FIG. 4 because the distances between the twisted conductor pairs in FIG. 3 are subject to greater variation than are those of FIG. 4. The relative distances between the twisted conductor pairs in the configuration of the embodiment of a multiple conductor electrical cable 110 constructed according to the design of FIG. 4 are larger than are the corresponding relative distances in the embodiment of the multiple conductor electrical cable 300 known in the art and depicted in FIG. 3.

Variations in relative position or distance between conductors will cause variations in the EMI at one conductor due to signals passing along the other conductor. The variation in relative position of-individual conductors in a twisted conductor pair with regard to the other twisted conductor pairs in a multiple conductor electrical cable is greater in a cable that embodies the structure depicted in FIG. 3 than in a cable that embodies the structure depicted in FIG. 4, if the multiple conductor electrical cables are constructed with the same wire components. The positions of the wires within a twisted conductor pair change as one moves along the multiple conductor electrical cable embodied by the designs shown in FIGS. 3 and 4. According to the embodiment shown in FIG. 3, for example, exchanging the relative positions of wire 332 of twisted conductor pair 1 and wire 330 of twisted conductor pair 3 with the positions of wire 330 of twisted conductor pair 1 and wire 332 of twisted conductor pair 3 causes a change of distance between wire pairs that is substantially the sum of the outside dimension of the insulated wire 330 and 332. In FIG. 4 by comparison, the relative change in position of wire 432 of twisted conductor pair 1 and wire 430 of twisted conductor pair 3 to the positions of wire 430 of twisted conductor pair 1 and wire 432 of twisted conductor pair 3 is significantly less. The larger the central region that is filled with material other than twisted wire pairs, the less the change in relative position of wires within a twisted pair conductor relative to the conductors in another twisted pair. Thus, the variation in EMI between twisted conductor pairs along the length of the multiple conductor electrical cable 110 of FIG. 4 may be expected to be less than the variation in EMI between twisted conductor pairs along the length of the multiple conductor electrical cable 300 of FIG. 3. A multiple conductor electrical cable 110 built using the principles of the invention can be expected to have both a lower level of EMI between different twisted conductor pairs and also a lower variation in EMI between different twisted conductor pairs.

Figure 5:
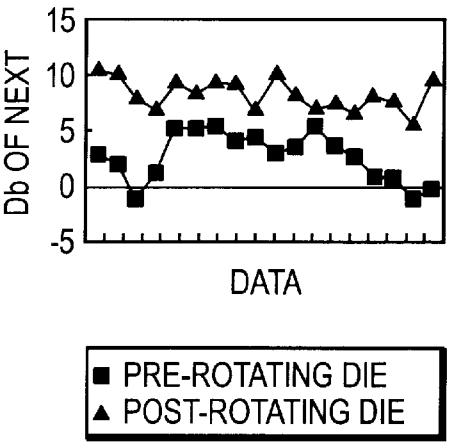
FIG. 5 shows a comparison of the results of testing multiple conductor electrical cable made according to the principles of the invention and using manufacturing methods that do not employ the principles of the invention.

FIG. 5 shows a comparison of the results of testing 100 meter segments of multiple conductor electrical cable 110 made according to the principles of the invention using a rotatable alignment die 140 and of multiple conductor electrical cable 300 made using manufacturing methods that do not involve the use of a rotating die 140. In this example, other than the use of the rotating die, the manufacture of the multiple conductor electrical cables 110 and 300 used the same manufacturing equipment, and the same cable components. The multiple conductor electrical cables 300 and 110 that were tested were manufactured in a single operation, in which the only difference in manufacturing practice was the use of the rotatable alignment die 140 of the invention for the manufacture of multiple conductor electrical cable 110 and the absence of use of rotatable alignment die 140 for the manufacture of multiple conductor electrical cable 300.

In FIG. 5 the results are presented both numerically and graphically. The results identified as "pre-rotating die" are results obtained from multiple conductor electrical cable 300 manufactured using the technology employed prior to the invention. The results identified as "post-rotating die" are results obtained from multiple conductor electrical cable 110 manufactured according to the principles of the invention using a rotatable alignment die 140. The units of the results are decibels (dB) of margin over the near end crosstalk (NEXT) required for compliance with Category 5e. A positive margin is preferable to a zero margin, and a negative margin is inferior to a zero margin.

A review of the information presented in FIG. 5 discloses that the multiple conductor electrical cable 300 manufactured using a fixed die exhibits three data points that actually fail the test based on Category 5e. The results for these three data points are negative, meaning that negative margin was observed. By comparison, there are no failing data points for the test results for multiple conductor electrical cable 110. The lowest (positive) margin for multiple conductor electrical cable 110, namely 5.5 dB, is a greater margin that any of the margins observed for the multiple conductor electrical cable 300. Furthermore, the cable 300 manufactured without use of the rotatable alignment die 140 did not exceed a maximum positive margin of 5.3 dB.

The statistical analyses of the results of the tests also are given in FIG. 5. The average margin for the multiple conductor electrical cable 110 manufactured according to the principles of the invention exceeds the average margin for the multiple conductor electrical cable 300 made without use of the rotatable alignment die 140 technology by 5.85 dB. The average improvement observed for the multiple conductor electrical cable 110 is larger than the largest positive margin observed for the multiple conductor electrical cable 300. Furthermore, the standard deviation of the margin about the mean for each multiple conductor electrical cable 110 and 330 is also presented. The standard deviation observed for the margin of the multiple conductor electrical cable 110 (i.e., 1.466 dB) is smaller than the standard deviation observed for the margin of the multiple conductor electrical cable 300, namely 2.146 dB. A smaller standard deviation computed on a series of numbers that is higher in average value demonstrates that the series with the higher average value is significantly narrower in variation. This confirms that the NEXT for the multiple conductor electrical cable 110 is appreciably better than that for the multiple conductor electrical cable 300. The NEXT margin for the multiple conductor electrical cable 110 is improved. The variation in NEXT for the multiple conductor electrical cable 110 is decreased. Both of these results are improvements over the cable made without using the principles of the invention. The improvements are attributed at least in part to the more desirable, more uniform and more closely controlled mutual mechanical alignment of the twisted conductor pairs 5, 6, 7, and 8 of multiple conductor electrical cable 110.

Equivalents

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. An apparatus for manufacturing a multiple conductor cable from a plurality of elongate conductors, comprising:

a rotatable aligning die including a plurality of apertures;

an applicator adapted to apply a binder to at least two of said plurality of conductors; and one or more motors that cause:

at least one of said plurality of elongate conductors to traverse along its elongate axis, and at least one of said plurality of elongate conductors to rotate substantially about its elongate axis;

whereby at least one of said plurality of elongate conductors is caused to traverse at least one of said apertures of said rotatable aligning die, said plurality of elongate conductors are brought into a defined mutual mechanical alignment, and said plurality of elongate conductors are retained in said mutual mechanical alignment at least partially by the application of said binder, producing said multiple conductor cable.

2. The apparatus of claim 1, further comprising:

a support situated substantially along a rotation axis of said die, said support stabilizing said mutual mechanical alignment of at least two of said plurality of elongate connectors.

3. The apparatus of claim 2, wherein said support is a consumable mechanical alignment component that is incorporated into the cable that is manufactured.

4. The apparatus of claim 1, further comprising:

a support fixture adapted to adjustably position said applicator relative to the position where said elongate conductors are brought into mutual mechanical alignment.

5. The apparatus of claim 1, wherein said applicator comprises an applicator that dispenses a heated binder material adapted to bind at least two of said plurality of conductors.

6. The apparatus of claim 1, wherein the rotatable aligning die comprises:

a rotatable body including a circular periphery and including a plurality of apertures therethrough, each of said plurality of apertures adapted to receive one or more elongate electrical conductors;

a fixing collar adapted to be adjustably attached to said apparatus for manufacturing a multiple conductor cable; and at least one bearing situated at the circular periphery of said rotatable body and supporting said rotatable body within said fixing collar; said body capable of rotating relative to said fixing collar, said apertures aligned in said body substantially transversely to a plane defined by said circular periphery of said body.

7. A rotatable aligning die for the manufacture of multiple conductor electrical cable, comprising:

a rotatable body including a circular periphery and including a plurality of apertures therethrough, each of said plurality of apertures adapted to receive one or more elongate electrical conductors;

a fixing collar adapted to be adjustably attached to said apparatus for manufacturing a multiple conductor cable; and at least one bearing situated at said circular periphery of said rotatable body and supporting said rotatable body within said fixing collar; said body capable of rotating relative to said fixing collar, said apertures aligned in said body substantially transversely to a plane defined by said circular periphery of said body and oriented at an angle non-parallel to a rotation axis of said rotatable body;

whereby the application of rotational force to at least one of said electrical conductors causes the rotation of the rotatable body.

8. A process for manufacturing a multiple conductor cable from a plurality of elongate conductors, comprising the steps of:

providing a rotatable aligning die including a plurality of apertures;

providing an applicator adapted to apply a binder to at least two of said plurality of conductors;

advancing at least one of said plurality of elongate conductors through at least one of said apertures of said rotatable aligning die;

rotating at least one of said plurality of elongate conductors about its elongated axis;

bringing said plurality of elongate conductors into a defined mutual mechanical alignment; and retaining at least two of said plurality of elongate conductors in said mutual mechanical alignment at least partially by the application of said binder.

9. The process of claim 8, further comprising the step of:

providing a consumable mechanical alignment component that is incorporated into said cable to stabilize said mutual mechanical alignment of at least two of said plurality of conductors.

10. The process of claim 8, further comprising the step of:

providing a support member disposed substantially along a rotation axis of said rotatable aligning die to stabilize the mutual mechanical alignment of at least two of said plurality of conductors, said support member not being incorporated into said cable.

11. A multiple conductor cable comprising a plurality of elongate conductors produced by the process of claim 8.

* * * * *